US009701152B2

(12) United States Patent
Ritter et al.

(10) Patent No.: US 9,701,152 B2
(45) Date of Patent: Jul. 11, 2017

(54) OPTICALLY VARIABLE SECURITY THREADS AND STRIPES

(75) Inventors: Gebhard Ritter, Lausanne (CH); Pierre Degott, Crissier (CH); Zhongdong Ye, Beijing (CN); Fangyi Sun, Beijing (CN); Weiru Wang, Beijing (CN); Chunhua Hu, Beijing (CN); Xiang Li, Beijing (CN)

(73) Assignees: SICPA HOLDING SA, Prilly (CH); CHINA BANKNOTE PRINTING AND MINTING CORPORATION, Beijing (CN); ZHONGCHAO SPECIAL SECURITY TECHNOLOGY CO., LTD., Beijing (CN); CHINA BANKNOTE SICPA SECURITY INK CO., LTD., Beijing (CN)

( * ) Notice: Subject to any disclaimer, the term of this patent is extended or adjusted under 35 U.S.C. 154(b) by 252 days.

(21) Appl. No.: 14/424,783

(22) PCT Filed: Aug. 29, 2012

(86) PCT No.: PCT/CN2012/080718

§ 371 (c)(1),
(2), (4) Date: Jul. 27, 2015

(87) PCT Pub. No.: WO2014/032238

PCT Pub. Date: Mar. 6, 2014

(65) Prior Publication Data

US 2015/0314629 A1 Nov. 5, 2015

(51) Int. Cl.
*B42D 25/00* (2014.01)
*B42D 25/351* (2014.01)
(Continued)

(52) U.S. Cl.
CPC ..... *B42D 25/355* (2014.10); *B42D 25/351* (2014.10); *B42D 25/40* (2014.10);
(Continued)

(58) Field of Classification Search
CPC ..... B42D 25/00; B42D 25/355; B42D 25/351
See application file for complete search history.

(56) References Cited

U.S. PATENT DOCUMENTS 964,014 A 7/1910 Gernaert
2,418,479 A 4/1947 Carlton et al.
(Continued)

FOREIGN PATENT DOCUMENTS

CN 101368352 2/2009
CN 102465473 5/2012
(Continued)

*Primary Examiner* — Kyle Grabowski
(74) *Attorney, Agent, or Firm* — Greenblum & Bernstein, P.L.C.

(57) ABSTRACT

Security threads or stripes include a substrate and i) a first optically variable layer imparting a first different color impression at different viewing angles, ii) a second optically variable layer imparting a second different color impression at different viewing angles, iii) a first color constant layer having a color matching the color impression of the first or second optically variable layer at a first viewing angle, iv) a second color constant layer having a color matching the color impression of the first or second optically variable layer at a second viewing angle, and v) one or more material-free regions, wherein the first optically variable layer, the second optically variable layer, the first color constant layer, the second color constant layer and the one or more material-free regions are jointly visible from one side of the security thread or stripe.

36 Claims, 3 Drawing Sheets

(51) Int. Cl.

| | |
|---|---|
| ***B42D 25/355*** | (2014.01) |
| ***B42D 25/40*** | (2014.01) |
| ***D21H 21/42*** | (2006.01) |
| ***D21H 21/44*** | (2006.01) |
| ***D21H 21/48*** | (2006.01) |

(52) U.S. Cl.
CPC ..... *D21H 21/42* (2013.01); *D21H 21/44* (2013.01); *D21H 21/48* (2013.01); *B42D 25/00* (2014.10)

(56) References Cited

U.S. PATENT DOCUMENTS

| | | | | |
|---|---|---|---|---|
| 2,570,856 | A | 10/1951 | Carlton et al. | |
| 3,676,273 | A | 7/1972 | Graves | |
| 3,791,864 | A | 2/1974 | Steingroever | |
| 4,652,015 | A | 3/1987 | Crane | |
| 4,705,300 | A | 11/1987 | Phillips et al. | |
| 4,705,356 | A | 11/1987 | Phillips et al. | |
| 4,721,271 | A | 1/1988 | Pera et al. | |
| 4,838,648 | A | 6/1989 | Phillips et al. | |
| 5,068,008 | A | 11/1991 | Crane | |
| 5,084,351 | A | 1/1992 | Phillips et al. | |
| 5,211,877 | A | 5/1993 | Luckas et al. | |
| 5,214,530 | A | 5/1993 | Phillips et al. | |
| 5,281,480 | A | 1/1994 | Phillips et al. | |
| 5,324,079 | A | 6/1994 | Kaule et al. | |
| 5,362,315 | A | 11/1994 | Maurer et al. | |
| 5,364,689 | A | 11/1994 | Tamura et al. | |
| 5,383,995 | A | 1/1995 | Phillips et al. | |
| 5,569,535 | A | 10/1996 | Phillips et al. | |
| 5,571,624 | A | 11/1996 | Phillips et al. | |
| 6,103,361 | A | 8/2000 | Batzar et al. | |
| 6,410,130 | B1 | 6/2002 | Richter et al. | |
| 6,423,246 | B1 | 7/2002 | Kasch et al. | |
| 6,531,221 | B1 | 3/2003 | Schmid et al. | |
| 6,582,781 | B1 | 6/2003 | Richter et al. | |
| 6,607,813 | B2 | 8/2003 | Washburn et al. | |
| 6,838,166 | B2 | 1/2005 | Phillips et al. | |
| 7,729,026 | B2 * | 6/2010 | Argoitia | B42D 25/00 359/2 |
| 2002/0160194 | A1 | 10/2002 | Phillips et al. | |
| 2004/0009309 | A1 | 1/2004 | Chu et al. | |
| 2004/0051297 | A1 | 3/2004 | Coombs et al. | |
| 2006/0202469 | A1 * | 9/2006 | Teitelbaum | B42D 25/29 283/72 |
| 2007/0241553 | A1 | 10/2007 | Heim et al. | |
| 2011/0095518 | A1 | 4/2011 | Dichtl et al. | |
| 2011/0215562 | A1 * | 9/2011 | Bleikolm | B42D 25/29 283/85 |

FOREIGN PATENT DOCUMENTS

| | | | | |
|---|---|---|---|---|
| DE | 2006848 | | 9/1971 | |
| DE | 102008031325 | A1 * | 1/2010 | B42D 25/29 |
| DE | EP 2465701 | A2 * | 6/2012 | B42D 25/41 |
| EP | 0021350 | | 1/1981 | |
| EP | 0185396 | | 6/1986 | |
| EP | 0303725 | | 2/1989 | |
| EP | 0319157 | | 6/1989 | |
| EP | 0518740 | | 12/1992 | |
| EP | 0601483 | | 6/1994 | |
| EP | 0608078 | | 7/1994 | |
| EP | 0635431 | | 1/1995 | |
| EP | 686675 | | 12/1995 | |
| EP | 0710508 | | 5/1996 | |
| EP | 1046692 | | 10/2000 | |
| EP | 1213338 | | 6/2002 | |
| EP | 1498545 | | 1/2005 | |
| EP | 2465701 | | 6/2012 | |
| WO | 90/08367 | | 7/1990 | |
| WO | 92/11142 | | 7/1992 | |
| WO | 96/04143 | | 2/1996 | |
| WO | 96/39685 | | 12/1996 | |
| WO | 98/19866 | | 5/1998 | |
| WO | 02/073250 | | 9/2002 | |
| WO | 02/090002 | | 11/2002 | |
| WO | 03/000801 | | 1/2003 | |
| WO | 2004/048120 | | 6/2004 | |
| WO | 2005/002866 | | 1/2005 | |
| WO | 2006/063926 | | 6/2006 | |
| WO | 2007/042865 | | 4/2007 | |
| WO | 2007/131833 | | 11/2007 | |
| WO | 2008/083894 | | 7/2008 | |
| WO | 2011/107527 | | 9/2011 | |

* cited by examiner

OPTICALLY VARIABLE SECURITY THREADS AND STRIPES

CROSS-REFERENCE TO RELATED APPLICATIONS

The present application is a U.S. National Stage of International Application No. PCT/CN2012/080718, filed Aug. 29, 2012, which published as WO 2014/032238A1 on Mar. 6, 2014, the disclosure of which is expressly incorporated by reference herein in its entirety.

FIELD OF THE DISCLOSURE

The present disclosure relates to the field of the protection of value documents and value commercial goods against counterfeit and illegal reproduction. In particular, the present disclosure is related to the field of security threads or stripes to be incorporated into or onto security documents and security documents comprising said security threads or stripes.

BACKGROUND OF THE DISCLOSURE

With the constantly improving quality of color photocopies and printings and in an attempt to protect security documents such as banknotes, value documents or cards, transportation tickets or cards, tax banderols, and product labels against counterfeiting, falsifying or illegal reproduction, it has been the conventional practice to incorporate various security measures in these documents. Typical examples of security measures include security threads or stripes, windows, fibers, planchettes, foils, decals, holograms, watermarks, security inks comprising optically variable pigments, magnetic or magnetizable thin film interference pigments, interference-coated particles, thermochromic pigments, photochromic pigments, luminescent, infrared-absorbing, ultraviolet-absorbing or magnetic compounds.

Security threads embedded in the substrate are known to those skilled in the art as an efficient measure for the protection of security documents and banknotes against imitation. Reference is made to U.S. Pat. No. 0,964,014; U.S. Pat. No. 4,652,015; U.S. Pat. No. 5,068,008; U.S. Pat. No. 5,324,079; WO 90/08367; WO 92/11142; WO 96/04143; WO 96/39685; WO 98/19866; EP-A 0 021 350; EP-A 0 185 396; EP-A 0 303 725; EP-A 0 319 157; EP-A 0 518 740; EP-A 0 608 078; EP-A 0 635 431; and EP-A 1 498 545 as well as the references cited therein. A security thread is a metal- or plastic-filament, which is incorporated during the manufacturing process into the substrate serving for printing security documents or banknotes. Security threads or stripes carry particular security elements, serving for the public- and/or machine-authentication of the security document, in particular for banknotes. Suitable security elements for such purpose include without limitation metallizations, optically variable compounds, luminescent compounds, micro-texts and magnetic features.

With the aim of protecting value documents such as banknotes from being forged, optically variable security threads or stripe exhibiting color shift or color change upon variation of the angle of observation have been proposed as security features to be incorporated into or onto said value documents. The protection from forgery is based on the variable color effect that optically variable security elements convey to the viewer in dependence on the viewing angle or direction.

WO 2004/048120 discloses security elements comprising at least two adjacent regions, wherein one of the regions is an optically variable and the other region has a layer of material with constant reflection. The disclosed security element comprises regions forming areas without material in order to form graphic makings, characters and the like that can be detected visually.

US 2007/0241553 discloses security elements for securing valuable articles having an optically variable layer that imparts different color impressions at different viewing angles and, in a covering area, a semi-transparent ink layer disposed on top of the optically variable, the color impression of the optically variable layer being coordinated with the color impression of the semi-transparent ink layer in the covering area when viewed under predefined viewing conditions.

WO 2007/042865 discloses security elements comprising at least two contiguous areas having an identical or different optically variable coloring. The disclosed security element further comprises a single graphic marking which crosses with continuity the two areas having variable coloring so that the graphic marking straddles the two areas and is perfectly aligned.

US 2011/0095518 discloses security elements for securing valuable articles comprising a stack layer made of an optically variable layer that conveys different color impressions at different viewing angles, and a color-constant layer comprising an ink layer and a metal layer. The optically variable layer and the color-constant layer are stacked in a covering region, while at most one of the optically variable layer and the color-constant layer is present outside the covering region. The color impression of the stacked layers in the covering region and the color impression of the one layer outside the covering region are matched with each other when viewed at a predetermined viewing angle.

EP-A 2 465 701 discloses security elements for securing valuable articles comprising a stack layer made of an optically variable layer that conveys different color impressions at different viewing angles, a first portion with a first color-constant impression and a second color-constant impression and an individualizing marking. The optically variable layer and the two portions exhibiting two color-constant impressions are stacked in a covering region. The disclosed different layers are coordinated so that the color impression of the optically variable layer matches at a predetermined first viewing angle the color impression of the first portion and that the color impression of the optically variable layer matches at a predetermined second viewing angle being different from the first viewing angle the color impression of the second portion.

WO 2011/107527 discloses threads or stripes comprising a hardened coating comprising oriented magnetic or magnetizable pigment particles, in particular optically variable magnetic or magnetizable pigments particles, said orientation of pigment particles representing graphic information.

A need remains for providing more sophisticated security threads or stripes so as to further increase the resistance against counterfeiting or illegal reproduction of security documents comprising said security threads or stripes.

SUMMARY OF EMBODIMENTS OF THE DISCLOSURE

There are disclosed and claims herein security threads or stripes comprising a substrate, and i) a first optically variable layer imparting a first different color impression at different viewing angles and being made of an optically variable composition comprising a plurality of optically variable pigments; ii) a second optically variable layer imparting a second different color impression at different viewing angles and being made of an optically variable composition comprising a plurality of optically variable pigments; iii) a first color constant layer having a color matching the color impression of the first or second optically variable layer at a first viewing angle and being made of a color constant composition comprising a binder and a plurality of inorganic pigments, organic pigments or mixtures thereof; iv) a second color constant layer having a color matching the color impression of the first or second optically variable layer at a second viewing angle and being made of a color constant composition comprising a binder and a plurality of inorganic pigments, organic pigments or mixtures thereof; and iv) one or more material-free regions, wherein the first different color impression is different from the second different color impression, wherein the first optically variable layer and the second optically variable layer either comprise one or more gaps in the form of indicia or consist of indicia made of the optically variable compositions, and wherein the first optically variable layer, the second optically variable layer, the first color constant layer, the second color constant layer and the one or more material-free regions are jointly visible from one side of the security thread or stripe.

Also described and claimed therein are uses of the security thread or stripe for the protection of a security document against counterfeiting or fraud.

Also described and claimed therein are security documents comprising the security threads or stripes and processes for making security documents comprising the security threads or stripes.

DETAILED DESCRIPTION OF EMBODIMENTS OF THE DISCLOSURE

Figure 1A:
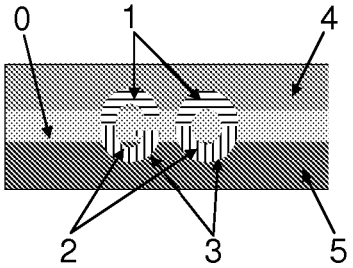
FIGS. 1 to 8 schematically depict top views of security threads and stripes according to embodiments the present disclosure according to several exemplary embodiments.
Figure 1B:
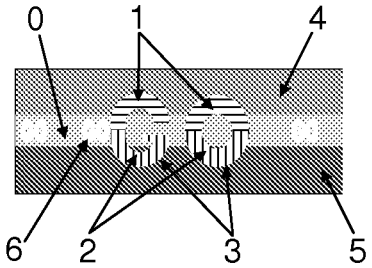
Figure 1C:
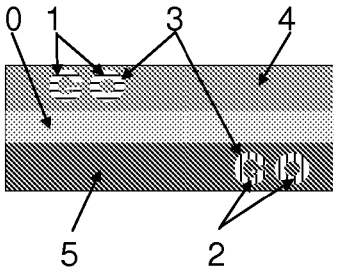
Figure 1D:
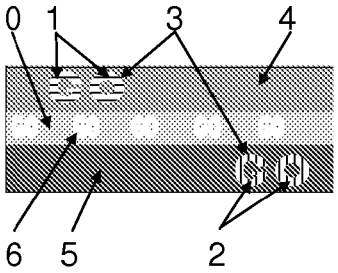
Figure 1E:
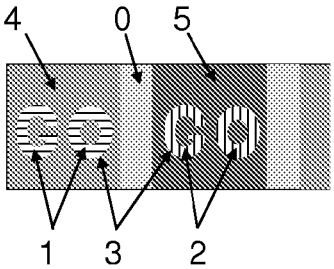
Figure 1F:
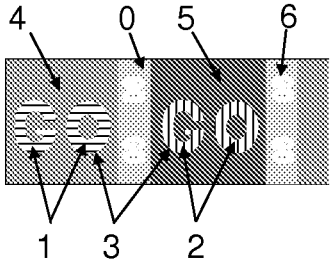
Figure 1G:
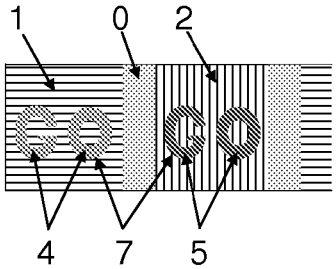
Figure 1H:
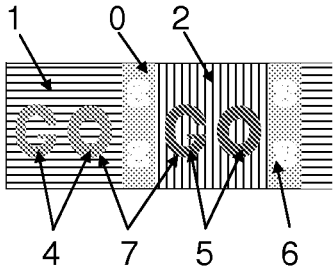
Figure 1I:
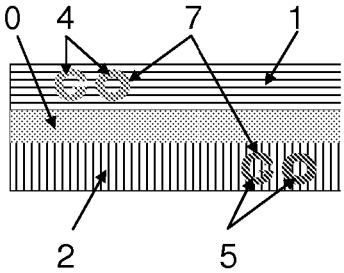
Figure 1J:
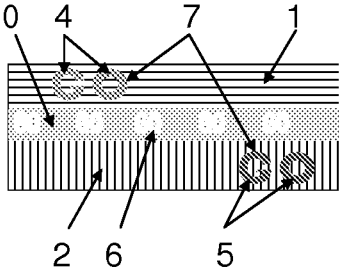

The following definitions are to be used to interpret the meaning of the terms discussed in the description and recited in the claims.

As used herein, the article "a" indicates one as well as more than one and does not necessarily limit its referent noun to the singular.

As used herein, the term "about" indicates that the amount or value in question may be the value designated or some other value about the same. The phrase is intended to convey that similar values within a range of ±5% of the indicated value promote equivalent results or effects according to the disclosure.

As used herein, the term and/or indicates that either all or only one of the elements of said group may be present. For example, "A and/or B" indicates "only A, or only B, or both A and B".

The term "composition" refers to any composition which is capable of forming a coating on a solid substrate and which can be applied preferentially but not exclusively by a printing method.

As used herein, the term "indicia" indicates discontinuous layers such as patterns, including without limitation symbols, alphanumeric symbols, motifs, letters, words, numbers, logos and drawings.

As used herein, the term "material-free" refers to "free from the first optically variable layer, the second optically variable layer, the first color constant layer, the second color constant layer and any non-transparent material such that the one or more material-free regions are visible from one side of the security thread or stripe".

A thread or stripe consists of an elongated security element. By "elongated", it is meant that the dimension of the security element in the longitudinal direction is more than twice as large as its dimension in the transverse direction. Preferably, the security thread or stripe according to embodiments of the present disclosure has a width, i.e. dimension in the transverse direction, between about 0.5 mm and about 30 mm, more preferably between about 0.5 mm and about 5 mm. Preferably, the security thread or stripe according to embodiments of the present disclosure has a thickness between about 10 and about 60 microns.

As used herein, the term "pigment" is to be understood according to the definition given in DIN 55943: 1993-11 and DIN EN 971-1: 1996-09. Pigments are materials in powder or flake form which are—contrary to dyes—not soluble in the surrounding medium.

As used herein, the terms "match" or "matched" are to be understood to indicate that two color impressions substantially appear to be identical.

Optically variable elements are known in the field of security printing. Optically variable elements (also referred in the art as goniochromatic elements or colorshifting elements) exhibit a viewing-angle or incidence-angle dependent color, and are used to protect banknotes and other security documents against counterfeiting and/or illegal reproduction by commonly available color scanning, printing and copying office equipment.

The security thread or stripe according to embodiments of the present disclosure invention combines different color areas that, under predefined viewing conditions, seem very similar or identical and that seem different when the security thread or stripe is tilted thus conferring a high counterfeit or illegal reproduction resistance.

The first optically variable layer described herein imparts a first different color impression at different viewing angles and the second optically variable layer described herein imparts a second different color impression at different viewing angles, wherein the first different color impression is different from the second different color impression. By "different color impression", it is meant that the element exhibits a difference of at least one parameter of the CIELAB (1976) system, preferably exhibits a different "a*" value or a different "b*" value or different "a*" and "b*" values at different viewing angles.

For example, the first optically variable layer exhibits a colorshift upon variation of the viewing angle (e.g., from an orthogonal view to a grazing view) from a color impression CI1 (e.g., magenta) to a color impression CI2 (green) and the second optically variable layer exhibits a colorshift upon variation of the viewing angle (e.g., from an orthogonal view to a grazing view) from a color impression CI3 (green) to a color impression CI4 (magenta), wherein the color impression CI1 looks identical or similar to the color impression CI4 to the naked eyes and the color impression CI2 looks identical or similar to the color impression CI3 to the naked eyes. The term "grazing view" refers to a viewing angle of about 0°±about 15° with respect to the plane of the security thread or stripe and the term "orthogonal view" (also referred in the art as incidence view or as face view) refers to a viewing angle of about 90°±about 15° with respect to the plane of the security thread or stripe.

The first optically variable layer, the second optically variable layer, the first color constant layer and the second color constant layer are coordinated in such a way that at least for a part of the security thread or stripe according to embodiments of the present disclosure, for example:

a1) at a predetermined viewing angle (for example, at the orthogonal view), the color impression of the first optically variable layer at this viewing angle is matched with the color impression of the first color constant layer in such a way that, for the viewer, the first constant layer and the first optically variable layer substantially exhibit a color impression appearing to be identical, a2) at the same predetermined viewing angle as in a1) (for example, at the orthogonal view), the color impression of the second optically variable layer at this viewing angle is matched with the color impression of the second color constant layer in such a way that, for the viewer, the second constant layer and the second optically variable layer substantially exhibit a color impression appearing to be identical, a3) at a different predetermined viewing angle (for example, at the grazing view), the color impression of the first optically variable layer at this viewing angle is matched with the color impression of the second color constant layer in such a way that, for the viewer, the second constant layer and the first optically variable layer substantially exhibit a color impression appearing to be identical, and a4) at the same different predetermined viewing angle as in a3) (for example, at the grazing view), the color impression of the second optically variable layer at this viewing angle is matched with the color impression of the first color constant layer in such a way that, for the viewer, the first constant layer and the second optically variable layer substantially exhibit a color impression appearing to be identical;

or b1) at a predetermined viewing angle (for example, at the orthogonal view), the color impression of the first optically variable layer at this viewing angle is matched with the color impression of the second color constant layer in such a way that, for the viewer, the second constant layer and the first optically variable layer substantially exhibit a color impression appearing to be identical, b2) at the same predetermined viewing angle as in b1) (for example, at the orthogonal view), the color impression of the second optically variable layer at this viewing angle is matched with the color impression of the first color constant layer in such a way that, for the viewer, the first constant layer and the second optically variable layer substantially exhibit a color impression appearing to be identical, b3) at a different predetermined viewing angle (for example, at the grazing view), the color impression of the first optically variable layer at this viewing angle is matched with the color impression of the first color constant layer in such a way that, for the viewer, the first constant layer and the first optically variable layer substantially exhibit a color impression appearing to be identical, and b4) at the same different predetermined viewing angle as in b3) (for example, at the grazing view), the color impression of the second optically variable layer at this viewing angle is matched with the color impression of the second color constant layer in such a way that, for the viewer, the second color constant layer and the second optically variable layer substantially exhibit a color impression appearing to be identical, or c1) at a predetermined viewing angle (for example, at the orthogonal view), the color impression of the first optically variable layer at this viewing angle is matched with the color impression of the first color constant layer in such a way that, for the viewer, the first constant layer and the first optically variable layer substantially exhibit a color impression appearing to be identical, c2) at the same predetermined viewing angle as in c1) (for example, at the orthogonal view), the color impression of the second optically variable layer at this viewing angle is matched with the color impression of the second color constant layer in such a way that, for the viewer, the second constant layer and the second optically variable layer substantially exhibit a color impression appearing to be identical, c3) at a different predetermined viewing angle (for example, at the grazing view), the color impression of the first optically variable layer at this viewing angle does not match with the color impression of the first color constant layer and does not match with the color impression of the second color constant layer, and c4) at the same different predetermined viewing angle as in c3) (for example, at the grazing view), the color impression of the second optically variable layer at this viewing angle does not match with the color impression of the first color constant layer and does not match with the color impression of the second color constant layer, or d1) at a predetermined viewing angle (for example, at the orthogonal view), the color impression of the first optically variable layer at this viewing angle is matched with the color impression of the second color constant layer in such a way that, for the viewer, the second color constant layer and the first optically variable layer substantially exhibit a color impression appearing to be identical, d2) at the same predetermined viewing angle as in d1) (for example, at the orthogonal view), the color impression of the second optically variable layer at this viewing angle is matched with the color impression of the first color constant layer in such a way that, for the viewer, the first color constant layer and the second optically variable layer substantially exhibit a color impression appearing to be identical, d3) at a different predetermined viewing angle (for example, at the grazing view), the color impression of the first optically variable layer at this viewing angle does not match with the color impression of the first color constant layer and does not match with the color impression of the second color constant layer, and d4) at the same different predetermined viewing angle as in d3) (for example, at the grazing view), the color impression of the second optically variable layer at this viewing angle does not match with the color impression of the first color constant layer and does not match with the color impression of the second color constant layer, or e1) at a predetermined viewing angle (for example, at the orthogonal view), the color impression of the first optically variable layer at this viewing angle is matched with the color impression of the first color constant layer in such a way that, for the viewer, the first constant layer and the first optically variable layer substantially exhibit a color impression appearing to be identical, e2) at the same predetermined viewing angle as in e1) (for example, at the orthogonal view), the color impression of the second optically variable layer at this viewing does not match with the color impression of the first color constant layer and does not match with the color impression of the second color constant layer, e3) at a different predetermined viewing angle (for example, at the grazing view), the color impression of the first optically variable layer at this viewing angle does not match with the color impression of the first color constant layer and does not match with the color impression of the second color constant layer, and e4) at the same different predetermined viewing angle as in e3) (for example, at the grazing view), the color impression of the second optically variable layer at this viewing angle is matched with the color impression of the second color constant layer in such a way that, for the viewer, the second constant layer and the second optically variable layer substantially exhibit a color impression appearing to be identical, or f1) at a predetermined viewing angle (for example, at the orthogonal view), the color impression of the first optically variable layer at this viewing angle does not match with the color impression of the first color constant layer and does not match with the color impression of the second color constant layer, f2) at the same predetermined viewing angle as in f1) (for example, at the orthogonal view), the color impression of the second optically variable layer at this viewing angle is matched with the color impression of the second color constant layer in such a way that, for the viewer, the second constant layer and the second optically variable layer substantially exhibit a color impression appearing to be identical, f3) at a different predetermined viewing angle (for example, at the grazing view), the color impression of the first optically variable layer at this viewing angle is matched with the color impression of the first color constant layer in such a way that, for the viewer, the first constant layer and the first optically variable layer substantially exhibit a color impression appearing to be identical, and f4) at the same different predetermined viewing angle as in f3) (for example, at the grazing view) the color impression of the second optically variable layer at this viewing angle does not match with the color impression of the first color constant layer and does not match with the color impression of the second color constant layer.

The first viewing angle under which the first color constant layer has a color matching the color impression of the first or the second optically variable layer may be different or may be the same as the second viewing angle under which the second color constant layer has a color matching the color impression of the first or the second optically variable layer. Advantageously, security threads or stripes wherein the first viewing angle under which the first color constant layer has a color matching the color impression of the first or second optically variable layer is different from the second viewing angle under which the second color constant layer has a color matching the color impression of the first or second optically variable layer exhibit a highly increased security against illegal reproduction because it will be highly difficult for a counterfeiter to mimic or copy the different color matchings under the two viewing angles.

The first optically variable layer, the second optically variable layer, the first color constant layer, the second color constant layer and the one or more material-free regions are jointly visible for a viewer from one side of the security thread or stripe.

The security thread or stripe according to embodiments of the present disclosure comprises a first optically variable layer made of an optically variable composition and a second optically variable layer made of an optically variable composition, said composition being different from the one of the first optically variable layer. Preferably, the first optically variable layer is disposed on top of the first color constant layer and/or the second color constant layer and, the second optically variable layer is disposed on top of the first color constant layer and/or the second color constant layer The optically variable compositions described herein comprise a binder and a plurality of optically variable pigments. Preferably, at least a part of the plurality of optically variable pigments consists of thin film interference pigments, magnetic thin film interference pigments, interference coated pigments cholesteric liquid crystal pigments and mixtures thereof. The optically variable composition of the first optically variable layer and the optically variable composition of the second optically variable layer may be based on the same type of optically variable pigments or may be based on different types of optically variable pigments. For example, the first optically variable layer is made of a composition comprising a plurality of thin film interference pigments and the second optically variable layer is made of a composition comprising a plurality of magnetic thin film interference pigments.

Suitable thin film interference pigments exhibiting optically variable characteristics are known to those skilled in the art and disclosed in U.S. Pat. No. 4,705,300; U.S. Pat. No. 4,705,356; U.S. Pat. No. 4,721,271; U.S. Pat. No. 5,084,351; U.S. Pat. No. 5,214,530; U.S. Pat. No. 5,281,480; U.S. Pat. No. 5,383,995; U.S. Pat. No. 5,569,535, U.S. Pat. No. 5,571,624 and in the thereto related documents. When at least a part of the plurality of optically variable pigments consists of thin film interference pigments, it is preferred that the thin film interference pigments comprise a Fabry-Perot reflector/dielectric/absorber multilayer structure, and more preferably a Fabry-Perot absorber/dielectric/reflector/dielectric/absorber multilayer structure, wherein the absorber layers are partially transmitting and partially reflecting, the dielectric layers are transmitting and the reflective layer is reflecting the incoming light. Preferably, the reflector layer is selected from the group consisting of metals, metal alloys and combinations thereof, preferably selected from the group consisting of reflective metals, reflective metal alloys and combinations thereof, and more preferably selected from the group consisting of aluminum (Al), chromium (Cr), nickel (Ni), and mixtures thereof, and still more preferably aluminum (Al). Preferably, the dielectric layers are independently selected from the group consisting of magnesium fluoride ($MgF_2$), silicium dioxide ($SiO_2$) and mixtures thereof, and more preferably magnesium fluoride ($MgF_2$). Preferably, the absorber layers are independently selected from the group consisting of chromium (Cr), nickel (Ni), metallic alloys and mixtures thereof, and more preferably chromium (Cr). When at least a part of the plurality of optically variable pigments consists of thin film interference pigments, it is particularly preferred that the thin film interference pigments comprise a Fabry-Perot absorber/dielectric/reflector/dielectric/absorber multilayer structure consisting of a $Cr/MgF_2/Al/MgF_2/Cr$ multilayer structure.

Suitable magnetic thin film interference pigments exhibiting optically variable characteristics are known to those skilled in the art and disclosed in U.S. Pat. No. 4,838,648; WO 02/073250; EP-A 686 675; WO 03/00801; U.S. Pat. No. 6,838,166; WO 2007/131833 and in the thereto related documents. Due to their magnetic characteristics being machine readable, compositions comprising magnetic thin film interference pigments may be detected, for example, with the use of specific magnetic detectors. Therefore, compositions comprising magnetic thin film interference pigments may be used as an authentication tool for security threads or stripes. When at least a part of the plurality of optically variable pigments consists of magnetic thin film interference pigments, it is preferred that the magnetic thin film interference pigments comprise a 5-layer Fabry-Perot absorber/dielectric/reflector/dielectric/absorber multilayer structure wherein the reflector and/or the absorber is also a magnetic layer and/or 7-layer a Fabry-Perot absorber/dielectric/reflector/magnetic/reflector/dielectric/absorber multilayer structure such as disclosed in U.S. Pat. No. 4,838,648; and more preferably a 7-layer Fabry-Perot absorber/dielectric/reflector/magnetic/reflector/dielectric/absorber multilayer structure. Preferably, the reflector layers described herein are selected from the group consisting of metals, metal alloys and combinations thereof, preferably selected from the group consisting of reflective metals, reflective metal alloys and combinations thereof, and more preferably from the group consisting of aluminum (Al), chromium (Cr), nickel (Ni), and mixtures thereof and still more preferably aluminum (Al). Preferably, the dielectric layers are independently selected from the group consisting of magnesium fluoride ($MgF_2$), silicium dioxide ($SiO_2$) and mixtures thereof, and more preferably magnesium fluoride ($MgF_2$). Preferably, the absorber layers are independently selected from the group consisting of chromium (Cr), nickel (Ni), metallic alloys and mixtures thereof, and more preferably chromium (Cr). Preferably, the magnetic layer is preferably selected from the group consisting of nickel (Ni), iron (Fe) and cobalt (Co) and mixtures thereof. When at least a part of the plurality of optically variable pigments consists of magnetic thin film interference pigments, it is particularly preferred that the magnetic thin film interference pigments comprise a 7-layer Fabry-Perot absorber/dielectric/reflector/magnetic/reflector/dielectric/absorber multilayer structure consisting of a Cr/$MgF_2$/Al/Ni/Al/$MgF_2$/Cr multilayer structure.

Thin film interference pigments and magnetic thin film interference pigments described herein are typically manufactured by vacuum deposition of the different required layers onto a web. After deposition of the desired number of layers, the stack of layers is removed from the web, either by dissolving a release layer in a suitable solvent, or by stripping the material from the web. The so-obtained material is then broken down to flakes which have to be further processed by grinding, milling or any suitable method. The resulting product consists of flat flakes with broken edges, irregular shapes and different aspect ratios.

Other magnetic color shifting pigments can be used as well, such as asymmetric magnetic thin film interference pigments, magnetic liquid crystal pigments or interference coated pigments including a magnetic material.

Suitable magnetic cholesteric liquid crystal pigments exhibiting optically variable characteristics include without limitation monolayered cholesteric liquid crystal pigments and multilayered cholesteric liquid crystal pigments and are disclosed for example in WO 2006/063926, U.S. Pat. No. 6,582,781 and U.S. Pat. No. 6,531,221. WO 2006/063926 discloses monolayers and pigments obtained therefrom with high brilliance and colorshifting properties with additional particular properties such as magnetizability. The disclosed monolayers and pigments obtained therefrom by comminuting said monolayers comprise a three-dimensionally cross-linked cholesteric liquid crystal mixture and magnetic nanoparticles. U.S. Pat. No. 6,582,781 and U.S. Pat. No. 6,410,130 disclose platelet-shaped cholesteric multilayer pigment which comprise the sequence $A^1/B/A^2$, wherein $A^1$ and $A^2$ may be identical or different and each comprises at least one cholesteric layer and B is an interlayer comprising absorption pigments imparting magnetic properties to said interlayer. U.S. Pat. No. 6,531,221 discloses platelet-shaped cholesteric multilayer pigment which comprise the sequence A/B and if desired C, wherein A and C consist of absorbing layers comprising pigment imparting magnetic properties and B is a cholesteric layer.

The magnetic interference pigments described herein, when incorporated into the optically variable composition may be further oriented after application and before drying or curing, through the application of an appropriate magnetic field and consecutively fixed in their respective positions and orientations by hardening the applied composition. Materials and technology for the orientation of magnetic particles in a coating composition, and corresponding combined printing/magnetic orienting processes have been disclosed in U.S. Pat. No. 2,418,479; U.S. Pat. No. 2,570,856; U.S. Pat. No. 3,791,864; DE-A 2006848; U.S. Pat. No. 3,676,273; U.S. Pat. No. 5,364,689; U.S. Pat. No. 6,103,361; US 2004/0051297; US 2004/0009309; EP-A 0 710 508, WO 02/090002; WO 03/000801; WO 2005/002866, and US 2002/0160194.

Suitable interference coated pigments include without limitation structures consisting of a substrate for the interference coated pigments selected from the group consisting of metallic cores such as titanium, silver, aluminum, copper, chromium, iron, germanium, molybdenum, tantalum or nickel, coated with one or more layers made of metal oxides, as well as structure consisting of a core made of synthetic or natural micas, another layered silicates (e.g., talc, kaolin and sericite), glasses (e.g., borosilicates), silicium dioxides ($SiO_2$), aluminum oxides ($Al_2O_3$), titanium oxides ($TiO_2$), graphites and mixtures thereof, coated with one or more layers made of metal oxides (e.g., titanium oxides, zirconium oxides, tin oxides, chromium oxides, nickel oxides, copper oxides and iron oxides), the structures described hereinabove have been described for example in Chem. Rev. 99 (1999), G. Pfaff and P. Reynders, pages 1963-1981 and WO 2008/083894. Typical examples of these interference coated pigments include without limitation silicium oxide cores coated with one or more layers made of titanium oxide, tin oxide and/or iron oxide; natural or synthetic mica cores coated with one or more layers made of titanium oxide, silicium oxide and/or iron oxide, in particular mica cores coated with alternate layers made of silicium oxide and titanium oxide; borosilicate cores coated with one or more layers made of titanium oxide, silicium oxide and/or tin oxide; and titanium oxide cores coated with one or more layers made of iron oxide, iron oxide-hydroxide, chromium oxide, copper oxide, cerium oxide, aluminum oxide, silicium oxide, bismuth vanadate, nickel titanate, cobalt titanate and/or antimony-doped, fluorine-doped or indium-doped tin oxide; aluminum oxide cores coated with one or more layers made of titanium oxide and/or iron oxide.

Liquid crystals in the cholesteric phase exhibit a molecular order in the form of a helical superstructure perpendicular to the longitudinal axes of its molecules. The helical superstructure is at the origin of a periodic refractive index modulation throughout the liquid crystal material, which in turn results in a selective transmission/reflection of determined wavelengths of light (interference filter effect). Cholesteric liquid crystal polymers can be obtained by subjecting one or more crosslinkable substances (nematic compounds) with a chiral phase to alignment and orientation. The particular situation of the helical molecular arrangement leads to cholesteric liquid crystal materials exhibiting the property of reflecting a circularly polarized light component within a determined wavelength range. The pitch can be tuned in particular by varying selectable factors including the temperature and solvents concentration, by changing the nature of the chiral component(s) and the ratio of nematic and chiral compounds. Crosslinking under the influence of UV radiation freezes the pitch in a predetermined state by fixing the desired helical form so that the color of the resulting cholesteric liquid crystal materials is no longer depending on external factors such as the temperature. Cholesteric liquid crystal materials may then be shaped to cholesteric liquid crystal pigments by subsequently comminuting the polymer to the desired particle size. Examples of films and pigments made from cholesteric liquid crystal materials and their preparation are disclosed in U.S. Pat. No. 5,211,877; U.S. Pat. No. 5,362,315 and U.S. Pat. No. 6,423,246 and in EP-A 1 213 338; EP-A 1 046 692 and EP-A 0 601 483, the respective disclosures of which are incorporated by reference herein in their entireties.

The optically variable layers described herein either comprise one or more gaps in the form of indicia, i.e. said layers comprise optically variable composition-free areas in the form of indicia, or consist of indicia made of the optically variable compositions described herein. In other words, the optically variable layers described herein comprise negative or positive writing in the form of indicia. As used herein, the term "indicia" shall indicate discontinuous layers such as patterns, including without limitation symbols, alphanumeric symbols, motifs, letters, words, numbers, logos and drawings. As used herein, the term "negative writing" refers to areas that do not comprise the optically variable compositions in an otherwise continuous layer.

FIGS. 1A to 1F illustrates security threads or stripes according to embodiments of the present disclosure, wherein the security threads or stripes comprise a first optically variable layer (1) and a second optically variable layer (2) consisting of indicia (3) made of the optically variable compositions and comprise a first color constant layer (4) and a second color constant layer (5). The security threads or stripes comprise a substrate with one or more material-free regions (0) on it. The substrate may consist of a metalized material optionally comprising clear text (6). FIGS. 1G to 1J illustrate security threads or stripes according to embodiments of the present disclosure, wherein the security threads or stripes comprise a first optically variable layer (1) and a second optically variable layer (2) comprising gaps in the form of indicia (7) and comprise a first color constant layer (4) and a second color constant layer (5) which are both visible from one side of the security thread or stripe through the gaps (7). The security threads or stripes comprise a substrate with one or more material-free regions (0). The substrate may consist of a metalized material optionally comprising clear text (6).

As known to those skilled in the art, ingredients comprised in a composition to be applied onto a substrate and the physical properties of said composition are determined by the nature of the process used to transfer the composition to the surface of the substrate. Consequently, the binder comprised in the optically variable composition described herein is typically chosen among those known in the art and depends on the coating or printing process used to apply the composition and the chosen curing process. The term "curing" or "curable" refers to processes including the hardening, drying or solidifying, reacting or polymerization of the applied composition in such a manner that it can no longer be removed from the surface onto which it is applied. As mentioned hereafter, the optically variable compositions described herein are preferably applied to a surface by a printing process selected from the group consisting of rotogravure, screen printing and flexography.

The first and second optically variable compositions described herein may be radiation curable compositions, thermal drying compositions or any combination thereof.

According to one aspect of the present disclosure, the optically variable compositions described herein consist of thermal drying compositions. Thermal drying compositions consist of compositions of any type of aqueous compositions or solvent-based compositions which are dried by hot air, infrared or by a combination of hot air and infrared.

Typical examples of thermal drying compositions comprises components including without limitation resins such as polyester resins, polyether resins, vinyl chloride polymers and vinyl chloride based copolymers, nitrocellulose resins, cellulose acetobutyrate or acetopropionate resins, maleic resins, polyamides, polyolefins, polyurethane resins, functionalized polyurethane resins (e.g., carboxylated polyurethane resins), polyurethane alkyd resins, polyurethane-(meth)acrylate resins, urethane-(meth)acrylic resins, styrene (meth)acrylate resins or mixtures thereof. The term "(meth) acrylate" or "(meth)acrylic" in the context of the present disclosure refers to the acrylate as well as the corresponding methacrylate or refers to the acrylic as well as the corresponding methacrylic.

As used herein, the term "solvent-based compositions" refers to compositions whose liquid medium or carrier substantially consists of one or more organic solvents. Examples of such solvents include without limitation alcohols (such as, for example, methanol, ethanol, isopropanol, n-propanol, ethoxy propanol, n-butanol, sec-butanol, tert-butanol, iso-butanol, 2-ethylhexyl-alcohol and mixtures thereof); polyols (such as, for example, glycerol, 1,5-pentanediol, 1,2,6-hexanetriol and mixtures thereof); esters (such as, for example, ethyl acetate, n-propyl acetate, n-butyl acetate and mixtures thereof); carbonates (such as, for example, dimethyl carbonate, diethylcarbonate, di-n-butylcarbonate, 1,2-ethylencarbonate, 1,2-propylenecarbonate, 1,3-propylencarbonate and mixtures thereof); aromatic solvents (such as, for example, toluene, xylene and mixtures thereof); ketones and ketone alcohols (such as, for example, acetone, methyl ethyl ketone, methyl isobutyl ketone, cyclohexanone, diacetone alcohol and mixtures thereof); amides (such as, for example, dimethylformamide, dimethyl-acetamide and mixtures thereof); aliphatic or cycloaliphatic hydrocarbons; chlorinated hydrocarbons (such as, for example, dichloromethane); nitrogen-containing heterocyclic compound (such as, for example, N-methyl-2-pyrrolidone, 1,3-dimethyl-2-imidazolidone and mixtures thereof); ethers (such as, for example, diethyl ether, tetrahydrofuran, dioxane and mixtures thereof); alkyl ethers of a polyhydric alcohol (such as, for example, 2-methoxyethanol, 1-methoxypropan-2-ol and mixtures thereof); alkylene glycols, alkylene thioglycols, polyalkylene glycols or polyalkylene thioglycols (such as, for example, ethylene glycol, polyethylene glycol (such as, for example, diethylene glycol, triethylene glycol, tetraethylene glycol), propylene glycol, polypropylene glycol (such as, for example, dipropylene glycol, tripropylene glycol), butylene glycol, thiodiglycol, hexylene glycol and mixtures thereof); nitriles (such as, for example, acetonitrile, propionitrile and mixtures thereof), and sulfur-containing compounds (such as, for example, dimethylsulfoxide, sulfolan and mixtures thereof). Preferably, the one or more organic solvents are selected from the group consisting of alcohols, esters and mixtures thereof.

According to one aspect of the present disclosure, the optically variable compositions described herein consist of radiation curable compositions. Radiation curable compositions consist of compositions that may be cured by UV-visible light radiation (hereafter referred as UV-Vis-curable) or by E-beam radiation (hereafter referred as EB). Radiation curable compositions are known in the art and can be found in standard textbooks such as the series "Chemistry & Technology of UV & EB Formulation for Coatings, Inks & Paints", published in 7 volumes in 1997-1998 by John Wiley & Sons in association with SITA Technology Limited. According to one embodiment of the present disclosure, the optically variable compositions described herein consist of UV-Vis-curable optically variable compositions. UV-Vis curing advantageously leads to very fast curing processes, and hence, drastically decreases the preparation time of security threads or stripes and security documents comprising said security threads or stripes. Preferably, the binder of the UV-Vis-curable optically variable compositions described herein is prepared from oligomers (also referred in the art as prepolymers) selected from the group consisting of radically curable compounds, cationically curable compounds and mixtures thereof. Cationically curable compounds are cured by cationic mechanisms consisting of the activation by energy of one or more photoinitiators that liberate cationic species, such as acids, which in turn initiate the polymerization so as to form the binder. Radically curable compounds are cured by free radical mechanisms consisting of the activation by energy of one or more photoinitiators that liberate free radicals, which in turn initiate the polymerization so as to form the binder. Preferably, the binder of the UV-Vis-curable optically variable compositions described herein is prepared from oligomers selected from the group consisting of oligomeric (meth) acrylates, vinyl ethers, propenyl ethers, cyclic ethers such as epoxides, oxetanes, tetrahydrofuranes, lactones, cyclic thioethers, vinyl and propenyl thioethers, hydroxyl-containing compounds and mixtures thereof. More preferably, the binder of the UV-Vis-curable optically variable compositions described herein is prepared from oligomers selected from the group consisting of oligomeric (meth)acrylates, vinyl ethers, propenyl ethers, cyclic ethers such as epoxides, oxetanes, tetrahydrofuranes, lactones and mixtures thereof.

According to one embodiment of the present disclosure, the binder of the UV-Vis-curable optically variable compositions described herein is prepared from radically curable compounds oligomeric selected from (meth)acrylates, preferably selected from the group consisting of epoxy (meth) acrylates, (meth)acrylated oils, polyester (meth)acrylates, aliphatic or aromatic urethane (meth)acrylates, silicone (meth)acrylates, amino (meth)acrylates, acrylic (meth)acrylates and mixtures thereof. The term "(meth)acrylate" in the context of the present disclosure refers to the acrylate as well as the corresponding methacrylate. The binder of the UV-Vis-curable optically variable compositions described herein may be prepared with additional vinyl ethers and/or monomeric acrylates such as, for example, trimethylolpropane triacrylate (TMPTA), pentaerytritol triacrylate (PTA), tripropyleneglycoldiacrylate (TPGDA), dipropyleneglycoldiacrylate (DPGDA), hexanediol diacrylate (HDDA) and their polyethoxylated equivalents such as, for example, polyethoxylated trimethylolpropane triacrylate, polyethoxylated pentaerythritol triacrylate, polyethoxylated tripropyleneglycol diacrylate, polyethoxylated dipropyleneglycol diacrylate and polyethoxylated hexanediol diacrylate.

According to another embodiment of the present disclosure, the binder of the UV-Vis-curable optically variable compositions described herein is prepared from cationically curable compounds selected from the group consisting of vinyl ethers, propenyl ethers, cyclic ethers such as epoxides, oxetanes, tetrahydrofuranes, lactones, cyclic thioethers, vinyl and propenyl thioethers, hydroxyl-containing compounds and mixtures thereof, preferably cationically curable compounds selected from the group consisting of vinyl ethers, propenyl ethers, cyclic ethers such as epoxides, oxetanes, tetrahydrofuranes, lactones and mixtures thereof. Typical examples of epoxides include without limitation glycidyl ethers, β-methyl glycidyl ethers of aliphatic or cycloaliphatic diols or polyols, glycidyl ethers of diphenols and polyphenols, glycidyl esters of polyhydric phenols, 1,4-butanediol diglycidyl ethers of phenolformalhedhyde novolak, resorcinol diglycidyl ethers, alkyl glycidyl ethers, glycidyl ethers comprising copolymers of acrylic esters (e.g., styrene-glycidyl methacrylate or methyl methacrylate-glycidyl acrylate), polyfunctional liquid and solid novolak glycidyl ethers resins, polyglycidyl ethers and poly(β-methylglycidyl) ethers, poly(N-glycidyl) compounds, poly(S-glycidyl) compounds, epoxy resins in which the glycidyl groups or β-methyl glycidyl groups are bonded to hetero atoms of different types, glycidyl esters of carboxylic acids and polycarboxylic acids, limonene monoxide, epoxidized soybean oil, bisphenol-A and bisphenol-F epoxy resins. Examples of suitable epoxides are disclosed in EP-B 2 125 713. Suitable examples of aromatic, aliphatic or cycloaliphatic vinyl ethers include without limitation compounds having at least one, preferably at least two, vinyl ether groups in the molecule. Examples of vinyl ethers include without limitation triethylene glycol divinyl ether, 1,4-cyclohexanedimethanol divinyl ether, 4-hydroxybutyl vinyl ether, propenyl ether of propylene carbonate, dodecyl vinyl ether, tert-butyl vinyl ether, tert-amyl vinyl ether, cyclohexyl vinyl ether, 2-ethylhexyl vinyl ether, ethylene glycol monovinyl ether, butanediol monovinyl ether, hexanediol monovinyl ether, 1,4-cyclohexanedimethanol monovinyl ether, diethylene glycol monovinyl ether, ethylene glycol divinyl ether, ethylene glycol butylvinyl ether, butane-1,4-diol divinyl ether, hexanediol divinyl ether, diethylene glycol divinyl ether, triethylene glycol divinyl ether, triethylene glycol methylvinyl ether, tetraethylene glycol divinyl ether, pluriol-E-200 divinyl ether, polytetrahydrofuran divinyl ether-290, trimethylolpropane trivinyl ether, dipropylene glycol divinyl ether, octadecyl vinyl ether, (4-cyclohexyl-methylene-oxyethene)-glutaric acid methyl ester and (4-butoxyethene)-iso-phthalic acid ester. Examples of hydroxy-containing compounds include without limitation polyester polyols such as, for example, polycaprolactones or polyester adipate polyols, glycols and polyether polyols, castor oil, hydroxy-functional vinyl and acrylic resins, cellulose esters, such as cellulose acetate butyrate, and phenoxy resins. Further examples of suitable cationically curable compounds are disclosed in EP-B 2 125 713 and EP-B 0 119 425.

Alternatively, the binder of the UV-Vis-curable optically variable compositions described herein is a hybrid binder and may be prepared from a mixture of radically curable compounds and cationically curable compounds such as those described herein.

UV-Vis curing of a monomer, oligomer or prepolymer may require the presence of one or more photoinitiators and may be effected in a number of ways. As known by those skilled in the art, the one or more photoinitiators are selected according to their absorption spectra and are selected to fit with the emission spectra of the radiation source. Depending on the monomers, oligomers or prepolymers used to prepare the binder comprised in the UV-Vis-curable optically variable compositions described herein, different photoinitiators might be used. Suitable examples of free radical photoinitiators are known to those skilled in the art and include without limitation acetophenones, benzophenones, alpha-aminoketones, alpha-hydroxyketones, phosphine oxides and phosphine oxide derivatives and benzyldimethyl ketals. Suitable examples of cationic photoinitiators are known to those skilled in the art and include without limitation onium salts such as organic iodonium salts (e.g., diaryl iodoinium salts), oxonium (e.g., triaryloxonium salts) and sulfonium salts (e.g., triarylsulphonium salts). Other examples of useful photoinitiators can be found in standard textbooks such as "Chemistry & Technology of UV & EB Formulation for Coatings, Inks & Paints", Volume III, "Photoinitiators for Free Radical Cationic and Anionic Polymerization", 2nd edition, by J. V. Crivello & K. Dietliker, edited by G. Bradley and published in 1998 by John Wiley & Sons in association with SITA Technology Limited. It may also be advantageous to include a sensitizer in conjunction with the one or more photoinitiators in order to achieve efficient curing. Typical examples of suitable photosensitizers include without limitation isopropyl-thioxanthone (ITX), 1-chloro-2-propoxy-thioxanthone (CPTX), 2-chloro-thioxanthone (CTX) and 2,4-diethyl-thioxanthone (DETX) and mixtures thereof. The one or more photoinitiators comprised in the UV-Vis-curable optically variable compositions are preferably present in an amount from about 0.1 to about 20 weight percent, more preferably about 1 to about 15 weight percent, the weight percents being based on the total weight of the UV-Vis-curable optically variable compositions.

The optically variable compositions described herein may further comprise one or more additives including without limitation compounds and materials which are used for adjusting physical, rheological and chemical parameters of the composition such as the viscosity (e.g., solvents and surfactants), the consistency (e.g., anti-settling agents, fillers and plasticizers), the foaming properties (e.g., antifoaming agents), the lubricating properties (waxes), UV stability (photosensitizers and photostabilizers) and adhesion properties, etc. Additives described herein may be present in the optically variable compositions disclosed herein in amounts and in forms known in the art, including in the form of so-called nano-materials where at least one of the dimensions of the particles is in the range of 1 to 1000 nm.

Alternatively, dual-cure compositions may be used; these compositions combine thermal drying and radiation curing mechanisms. Typically, such compositions are similar to radiation curing compositions but include a volatile part constituted by water or by solvent. These volatile constituents are evaporated first using hot air or IR driers, and UV drying is then completing the hardening process.

The optically variable compositions described herein may be prepared by dispersing or mixing the plurality of optically variable pigments described herein, and the one or more additives when present in the presence of the binder described herein, thus forming liquid inks. When present, the one or more photoinitiators may be added to the composition either during the dispersing or mixing step of all other ingredients or may be added at a later stage, i.e. after the formation of the liquid inks.

Figure 2A:
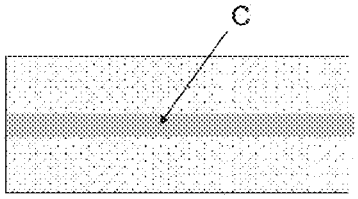
Figure 2B:
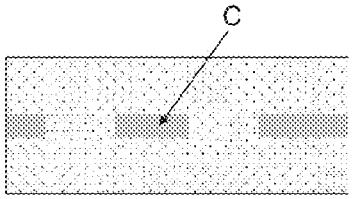
Figure 3A:
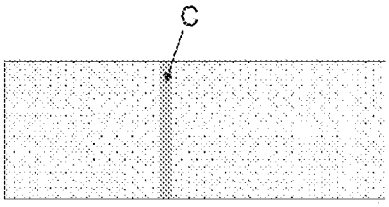
Figure 3B:
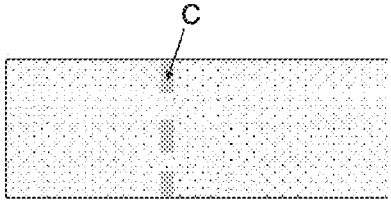
Figure 4:
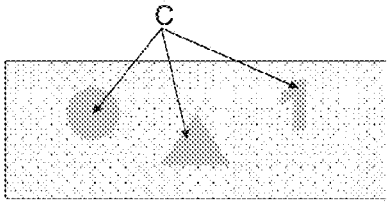

As shown and exemplified in FIGS. 2A and 2B, the security thread or stripe according to embodiments of the present disclosure comprises the one or more material-free regions (C) on the substrate described herein, wherein the one or more material-free regions (C) may be present along the length of the security thread or stripe according to embodiments of the present disclosure. The one or more material-free regions (C) on the substrate described herein may be continuously present along the length of the security thread or stripe according to embodiments of the present disclosure (FIG. 2A) or discontinuously present (FIG. 2B). As shown and exemplified in FIGS. 3A and 3B, the security thread or stripe according to embodiments of the present disclosure comprises the one or more material-free regions (C) on the substrate described herein, wherein the one or more material-free regions (C) may be present along the width of the security thread or stripe according to embodiments of the present disclosure. The one or more material-free regions (C) on the substrate described herein may be continuously present along the width of the security thread or stripe according to embodiments of the present disclosure (FIG. 3A) or discontinuously present (FIG. 3B). Alternatively, and as shown and exemplified in FIG. 4, the security thread or stripe according to embodiments of the present disclosure comprises the one or more material-free regions (C) on the substrate described herein, wherein the one or more material-free regions may be present in the form of indicia. The one or more material-free regions (C) depicted in FIGS. 2 to 4 are adjacent to one or more layers selected from the group consisting of the first optically variable layers, the second optically variable layers, the first color constant layers, the second color constant layers and combinations thereof.

Preferably, the first optically variable layer described herein is disposed on top of the first color constant layer and/or the second color constant layer, and the second optically variable layer is disposed on top of the first color constant layer and/or the second color constant layer. In contrast to the optically variable layer that exhibit different colors or color impressions upon variation of the viewing angle, the color constant layers described herein consist of layers that do not exhibit a color change or color impression change upon variation of the viewing angle. The first color constant layer described herein is made of a color constant composition and the second color constant layer is made of a color constant composition, said color constant composition being different from the one of the first color constant layer. Color constant compositions typically comprise a binder such as those described hereinabove and a plurality of inorganic pigments, organic pigments or mixtures thereof. Typical examples of inorganic pigments include without limitation C.I. Pigment Yellow 12, C.I. Pigment Yellow 42, C.I. Pigment Yellow 93, 109, C.I. Pigment Yellow 110, C.I. Pigment Yellow 147, C.I. Pigment Yellow 173, C.I. Pigment Orange 34, C.I. Pigment Orange 48, C.I. Pigment Orange 49, C.I. Pigment Orange 61, C.I. Pigment Orange 71 C.I. Pigment Orange 73, C.I. Pigment Red 9, C.I. Pigment Red 22, C.I. Pigment Red 23, C.I. Pigment Red 67, C.I. Pigment Red 122, C.I. Pigment Red 144, C.I. Pigment Red 146, C.I. Pigment Red 170, C.I. Pigment Red 177, C.I. Pigment Red 179, C.I. Pigment Red 185, C.I. Pigment Red 202, C.I. Pigment Red 224, C.I. Pigment Red 242, C.I. Pigment Red 254, C.I. Pigment Red 264, C.I. Pigment Brown 23, C.I. Pigment Blue 15, C.I. Pigment Blue 15:3, C.I. Pigment Blue 60, C.I. Pigment Violet 19, C.I. Pigment Violet 23, C.I. Pigment Violet 32, C.I. Pigment Violet 37, C.I. Pigment Green 7, C.I. Pigment Green 36, C.I. Pigment Black 7, C.I. Pigment Black 11, metal oxides, antimony yellow, lead chromate, lead chromate sulfate, lead molybdate, ultramarine blue, cobalt blue, manganese blue, chrome oxide green, hydrated chrome oxide green, cobalt green and metal sulfides, such as cerium or cadmium sulfide, cadmium sulfoselenides, zinc ferrite, bismuth vanadate, Prussian blue, $Fe_3O_4$, carbon black and mixed metal oxides. Typical examples of organic pigments include without limitation azo, azomethine, methine, anthraquinone, phthalocyanine, perinone, perylene, diketopyrrolopyrrole, thioindigo, thiazinindigo, dioxazine, iminoisoindoline, iminoisoindolinone, quinacridone, flavanthrone, indanthrone, anthrapyrimidine and quinophthalone pigments. Other pigments such as iridescent or metallic pigments can also be used in combination with the inorganic and organic pigments described herein.

Figure 5A:
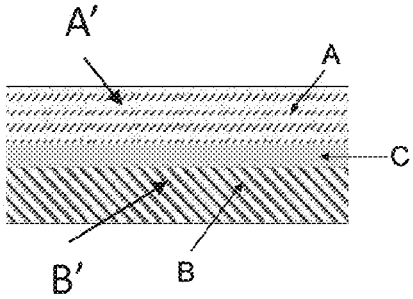
Figure 5B:
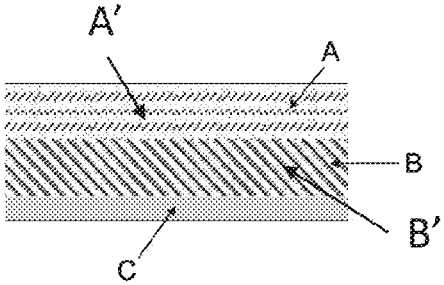

The first color constant layer may be adjacent or not adjacent to the second color constant layer. By "adjacent", it is meant that the first color constant layer and the second color constant layer are in direct contact. FIG. 5A illustrates and exemplified a security thread or stripe according to embodiments of the present disclosure, wherein the first color constant layer (A) is not adjacent to the second color constant layer (B) and wherein the material-free region (C) is adjacent to both the first and the second color constant layers. FIG. 5B illustrates a security thread or stripe according to embodiments of the present disclosure, wherein the first color constant layer (A) is longitudinally adjacent to the second color constant layer (B) and wherein the material-free region (C) is adjacent to the second color constant layer (B). Alternatively, the material-free region may be adjacent to the first color constant layer.

Figure 6A:
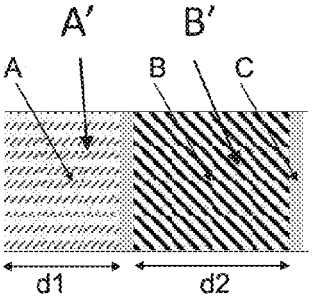
Figure 6B:
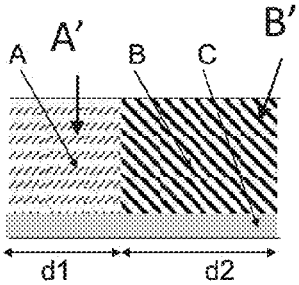

As shown and exemplified in FIGS. 6A and 6B, the first color constant layer (A) and the second color constant layer (B) of the security thread or stripe according to embodiments of the present disclosure may be arranged along the length of the security thread or stripe of the present disclosure in an alternative sequence or repetitive pattern. The length of each of the first (d1) and the second (d2) color constant layer may be identical, similar or different all along the length of the security thread or stripe according to embodiments of the present disclosure. FIG. 6A illustrates a security thread or stripe according to embodiments of the present disclosure, wherein the first color constant layer (A) is not adjacent to the second color constant layer (B). When the first color constant layer is not adjacent to the second color constant layer, the one or more material-free regions may be either adjacent to one of the first or second color constant layer, or adjacent to both the first and second color constant layers. FIG. 6B illustrates a security thread or stripe according to embodiments of the present disclosure, wherein the first color constant layer (A) is adjacent to the second color constant layer (B) and the one or more material-free regions (C) are adjacent to both the first color constant layer (A) and the second color-constant layer (B). When the first color constant layer is adjacent to the second color constant layer, the one or more material-free regions may be either adjacent to one of the first or second color constant layer or adjacent to both the first and second color constant layers.

Figure 7A:
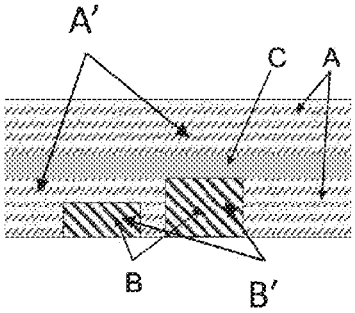
Figure 7B:
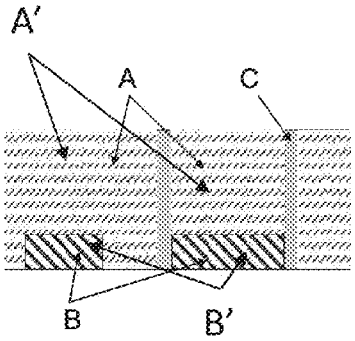
Figure 8A:
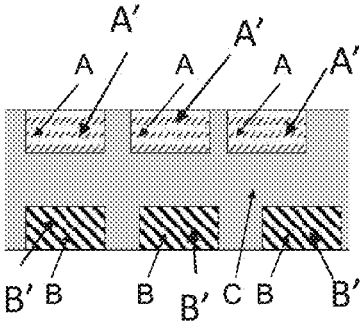
Figure 8B:
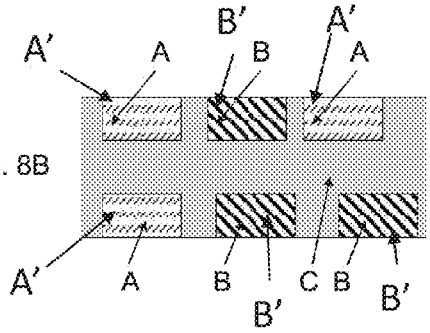
Figure 8C:
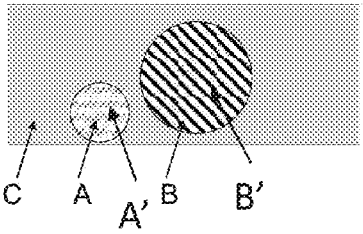
Figure 8D:
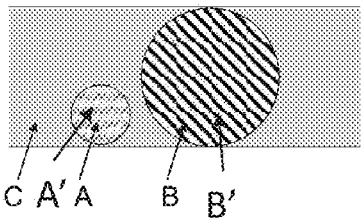

As shown and exemplified in FIGS. 7A and 7B, the first color constant layer (or alternatively, the second color constant layer) may be continuously present on at least one part of the security thread or stripe according to embodiments of the present disclosure, and the second color constant layer (or alternatively, the first color constant layer) is discontinuously present and has a pre-defined design such as, for example, round or circular shapes, polygonal shapes and indicia. The pre-defined design may partially or completely extend across the width of the security thread or stripe of the present disclosure. The one or more material-free regions may be either adjacent to one of the first or second color constant layer or adjacent to both the first and second color constant layers.

As shown and exemplified in FIGS. 8A to 8D, both the first and the second color constant layers may be discontinuously present on at least one part of the security thread or stripe according to embodiments of the present disclosure and have a pre-defined design such as, for example, round or circular shapes, polygonal shapes and indicia. The sequence of the first and the second color constant layers along the length the security thread or stripe according to embodiments of the present disclosure may be regular or irregular. The pre-defined design of the first color constant layer and/or the second color constant layer may partially or completely extend across the width of the security thread or stripe of the present disclosure.

When the first color constant layer is adjacent to the second color constant layer, the second color constant layer may be disposed on one or more covering areas on top of the first color constant layer. Alternatively, the first color constant layer may be disposed on one or more covering areas on top of the second color constant layer. When the first color constant layer (or alternatively, the second color constant layer) or a part of the first color constant layer (or alternatively, a part of the second color constant layer) is covered by the second color constant layer (or alternatively, the first color constant layer), both color constant layers shall be viewable from one side, preferably the top surface (i.e., the surface facing the optically variable layers), of the security thread or the stripe according to the present disclosure through the one or more gaps in the form of indicia of the first and second optically variable layers, or through regions of the first and second optically variable layers lacking of the optically variable composition (i.e., regions outside the indicia made of the first or the second optically variable compositions).

The first optically variable layer and the second optically variable layer described herein may be adjacent to each other or may not be adjacent to each other. In analogy with the structures of the color constant layers described in FIGS. 5 to 8, wherein A', in the context of the discussion of the optically variable layers, corresponds to the first optically variable layer and B' corresponds to the second optically variable layer, or alternatively A' corresponds to the second optically variable layer and B' corresponds to the first optically variable layer. The first optically variable layer and the second optically variable layer may be arranged in different ways such as those disclosed in FIGS. 5 to 8 provided that the first optically variable layer and the second optically variable layer either comprise one or more gaps in the form of indicia or consist of indicia made of the optically variable compositions so that the first color constant layer, the second color constant layer and the one or more material-free regions are visible from one side of the security thread or stripe.

Each embodiment or example described in FIGS. 5 to 8 for the first and second color constants layers (A and B) may be combined with each embodiment or example described in FIGS. 5 to 8 for the first and second optically variable layers (A' and B').

Each embodiment or example described in FIGS. 5 to 8 for the first and second color constant layers (A and B) may be combined with i) each embodiment or example described in FIGS. 5 to 8 for the first and second optically variable layers (A' and B') and/or ii) each embodiment or example described in FIGS. 2 to 4 for the one or more material-free regions (C).

The security thread or stripe according to aspects of the present disclosure comprises a substrate. Preferably, the substrate is selected from the group consisting of plastics, polymers, composite materials, metals, metalized materials and mixtures thereof. Typical examples of polymer or plastic substrates include polyolefins such as polyethylene and polypropylene, polyamides, polyesters such as poly(ethylene terephthalate) (PET), poly(1,4-butylene terephthalate) (PBT), poly(ethylene 2,6-naphthoate) (PEN) and polyvinylchlorides (PVC). Typical examples of composite materials include without limitation multilayer structures or laminates of paper and at least one plastic or polymer material such as those described hereinabove. Typical example of metals include without limitation aluminum (Al), chromium (Cr), copper (Cu), gold (Au), iron (Fe), nickel (Ni), silver (Ag), combinations thereof or alloys of two or more of the aforementioned metals. Alternatively, the substrate may be a laminated structure consisting of two layers laminated together and optionally comprising a security element and/or metallization between the two layers. The substrate may be colored.

The metalized materials described herein may comprise a surface relief in the form of an embossed diffraction structure.

Preferably, the substrate described herein is a metalized material. Typical examples of metalized materials include without limitation plastic or polymer materials having a metal such as those described hereinabove disposed either continuously or discontinuously on their surface. The metallization of the material described hereinabove may be done by an electrodeposition process, a high-vacuum coating process or by a sputtering process and may be continuous or discontinuous. Typically, the metal has a thickness between about 1 and about 100 nanometers (nm).

More preferably, the substrate described herein is a metalized material further comprising indicia. Said indicia may consist of positive text or clear text. By "positive text", it is meant that the indicia consist of a metal surrounded by a demetalized area and by "clear text", it is meant that the indicia consist of negative text, i.e. a metal material comprising demetalized parts in the form of indicia in negative writing. Preferably, the substrate described herein is a metalized material further comprising indicia in the form of clear text, said indicia being visible from one side of the security thread or stripe. More preferably, the indicia in the form of clear text present on the metalized material described herein is disposed in register with the one or more material-free regions so as to be visible from one side of the security thread or stripe, and more preferably to be jointly visible with the first optically variable layer, the second optically variable layer, the first color constant layer and the second color constant layer. The demetalized parts may be produced by processes known to those skilled in the art such as, for example, chemical etching, laser etching or washing methods.

With the aim of increasing the wear and soil resistance or with the aim of modifying the optical gloss or aesthetic appearance of the security thread or stripe according to the present disclosure, the security thread or stripe according to the present disclosure may further comprise one or more protective layers over the first and second optically variable layers. When present, the one or more protective layers may be continuous or discontinuous. When present, the one or more protective layers are typically made of protective varnishes that are transparent or slightly colored or tinted so that the first optically variable layer, the second optically variable layer, the first color constant layer, the second color constant layer and the one or more material-free regions are visible from one side of the security thread or stripe according to the present disclosure. The one or more protective varnish may be more or less glossy. Protective varnishes may be radiation curable compositions, thermal drying compositions or any combination thereof such as those described hereinabove. Preferably, the one or more protective layers are made of radiation curable, more preferably UV-Vis curable compositions.

The security thread or stripe according to the present disclosure may further comprise one or more additional layers preferably selected from the group consisting of adhesive layers, lacquers, machine readable layers, hiding layers and combinations thereof. When present, the one or more additional layers may be continuous or discontinuous.

The security thread or stripe according to the present disclosure may further comprise one or more adhesive layers on at least one surface of said security thread or stripe so as to provide adherence to the substrate of a security document upon incorporation of the thread or stripe into or onto said substrate.

With the aim of facilitating an automatic authenticity check of the security thread or stripe according to the present disclosure or a security document comprising said security thread or stripe by an authentication apparatus such as, for example, an automatic teller machine (ATMs), the thread according to the present disclosure may further comprise one or more machine readable layers. When present, the one or more machine readable layers preferably comprise a machine readable material selected from the group consisting of magnetic materials, luminescent materials, electrically conductive materials, infrared-absorbing materials and mixtures thereof. As used herein, the term "machine readable material" refers to a material that exhibits at least one distinctive property which is not perceptible by the naked eye, and which can be comprised in a layer so as to confer a way to authenticate said layer or article comprising said layer by the use of a particular equipment for its authentication.

With the aim of further increasing the resistance against counterfeiting or illegal reproduction of the security thread or stripe according to the present disclosure, it might be advantageous to add one or more hiding layers so as to camouflage any information that is present in the security thread or stripe such, as for example, any information related to the one or more machine readable layers described hereinabove. For example, magnetic or other machine readable information that is visually discernible could be more easily counterfeited if the potential counterfeiter can detect the presence and/or the placement of the magnetic regions to read. If the magnetic or other machine readable information cannot be visually seen, the counterfeiter will not be motivated to reproduce this information and therefore the counterfeiting will fail and be easily detected if illegal reproduced. Therefore, the security thread or stripe according to the present disclosure may further comprise one or more hiding layers. Typical examples of hiding layers include without limitation aluminum layers, black layers, white layers, opaque colored layers and metalized layers and combination of thereof.

Also described herein are processes for making the security threads or stripes according to the present disclosure and security threads or stripes obtained therefrom. The security threads or stripes according to the present disclosure may be prepared by a process comprising the steps of:

a) applying, preferably by a printing process selected from the group consisting of rotogravure, screen and flexography printing, the color constant composition described herein so as to form the first color constant layer onto the substrate described herein, b) applying, preferably by a printing process selected from the group consisting of rotogravure, screen and flexography printing, the color constant composition described herein so as to form the second color constant layer on the structure obtained under step a), wherein the color constant composition of step b) is different from the color constant composition of step a)

c) applying the optically variable composition described herein so as to form a first optically variable layer on the structure obtained under step b) by a process selected from the group consisting of rotogravure, screen and flexography printing either while keeping one or more gaps in the form of indicia or by applying the optically variable composition in the form of indicia, d) applying the optically variable composition described herein so as to form a second optically variable layer on the structure obtained under step c) by a process selected from the group consisting of rotogravure, screen and flexography printing either while keeping one or more gaps in the form of indicia or by applying the optically variable composition in the form of indicia, wherein the optically variable composition of step d) is different from the optically variable composition of step c), e) optionally applying a second substrate on the structure obtained under step d), and f) optionally applying a thermoadhesive layer on one or both sides of the structure obtained under step d) or step e), wherein the compositions of steps a) to d) are applied while keeping one or more material-free regions on the substrate.

When the security threads or stripes according to the present disclosure consist of structures wherein the first optically variable layer is disposed on top of the first color constant layer and/or the second color constant layer, and the second optically variable layer is disposed on top of the first color constant layer and/or the second color constant layer, those security threads or stripe may be prepared by a process comprising the steps of:

a) applying, preferably by a printing process selected from the group consisting of rotogravure, screen and flexography printing, the color constant composition described herein so as to form the first color constant layer onto the substrate described herein, b) applying, preferably by a printing process selected from the group consisting of rotogravure, screen and flexography printing, the color constant composition described herein so as to form the second color constant layer on the structure obtained under step a), wherein the color constant composition of step b) is different from the color constant composition of step a)

c) applying the optically variable composition described herein so as to form a first optically variable layer on the first color constant layer and/or on the second color constant layer of the structure obtained under step b) by a process selected from the group consisting of rotogravure, screen and flexography printing either while keeping one or more gaps in the form of indicia or by applying the optically variable composition in the form of indicia, d) applying the optically variable composition described herein so as to form a second optically variable layer on the first color-constant layer and/or on the second color constant layer of the structure obtained under step c) by a process selected from the group consisting of rotogravure, screen and flexography printing either while keeping one or more gaps in the form of indicia or by applying the optically variable composition in the form of indicia, wherein the optically variable composition of step d) is different from the optically variable composition of step c), e) optionally applying a second substrate on the structure obtained under step d), and f) optionally applying a thermoadhesive layer on one or both sides of the structure obtained under step d) or step e), wherein the compositions of steps a) to d) are applied while keeping one or more material-free regions on the substrate. In a preferred embodiment, in step e), a second substrate is applied on the structure obtained under step d). In such a preferred process, the compositions of steps a) to d) are applied while keeping one or more material-free regions on at least one of the substrates, preferably on the substrate of step a), i.e. the substrate facing the color constant layer(s).

Alternatively, the security threads or stripes according to the present disclosure may be prepared by a process comprising the steps of:

a) applying the optically variable composition described herein so as to form a first optically variable layer on a substrate by a process selected from the group consisting of rotogravure, screen and flexography printing either while keeping one or more gaps in the form of indicia or by applying the optically variable composition described herein in the form of indicia, b) applying the optically variable composition described herein so as to form a second optically variable layer on the structure obtained under step a) by a process selected from the group consisting of rotogravure, screen and flexography printing either while keeping one or more gaps in the form of indicia or by applying the optically variable composition in the form of indicia, wherein the optically variable composition of step b) is different from the optically variable composition of step a), c) applying, preferably by a printing process selected from the group consisting of rotogravure, screen and flexography printing, the color constant composition described herein so as to form the first color constant layer described herein on the structure obtained under step b), d) applying, preferably by a printing process selected from the group consisting of rotogravure, screen and flexography printing, the color constant composition described herein so as to form the second color constant layer described herein on the structure obtained under step c), wherein the color constant composition of step d) is different from the color constant composition of step c)

e) optionally applying a second substrate on the structure obtained under step d), and f) optionally applying a thermoadhesive layer on one or both sides of the structure obtained under step d) or e), wherein the compositions of steps a) to d) are applied while keeping one or more material-free regions on the substrate.

Alternatively and when the security threads or stripes according to the present disclosure consist of structures wherein the first optically variable layer is disposed on top of the first color constant layer and/or the second color constant layer, and the second optically variable layer is disposed on top of the first color constant layer and/or the second color constant layer, those security threads or stripe may be prepared by a process comprising the steps of:

a) applying the optically variable composition described herein so as to form a first optically variable layer on a substrate by a process selected from the group consisting of rotogravure, screen and flexography printing either while keeping one or more gaps in the form of indicia or by applying the optically variable composition described herein in the form of indicia, b) applying the optically variable composition described herein so as to form a second optically variable layer on the structure obtained under step a) by a process selected from the group consisting of rotogravure, screen and flexography printing either while keeping one or more gaps in the form of indicia or by applying the optically variable composition in the form of indicia, wherein the optically variable composition of step b) is different from the optically variable composition of step a), c) applying, preferably by a printing process selected from the group consisting of rotogravure, screen and flexography printing, the color constant composition described herein so as to form the first color constant layer described herein on the first optically variable layer and/or on the second optically variable layer of the structure obtained under step b), d) applying, preferably by a printing process selected from the group consisting of rotogravure, screen and flexography printing, the color constant composition described herein so as to form the second color constant layer described herein on the first optically variable layer and/or on the second optically variable layer of the structure obtained under step c), wherein the color constant composition of step d) is different from the color constant composition of step c)

e) optionally applying a second substrate on the structure obtained under step d), and f) optionally applying a thermoadhesive layer on one or both sides of the structure obtained under step d) or e), wherein the compositions of steps a) to d) are applied while keeping one or more material-free regions on the substrate. In a preferred embodiment, in step e), a second substrate is applied on the structure obtained under step d). In such a preferred process, the compositions of steps a) to d) are applied while keeping one or more material-free regions on at least one of the substrates, preferably on the second substrate, i.e., the substrate facing the color constant layer (s). In another aspect of the disclosure, in a preferred embodiment of the disclosure, in step a), the optically variable composition so as to form a first optically variable layer is applied on the substrate, in step b), the optically variable composition so as to form a second optically variable layer is applied on the structure obtained under step a) on the substrate, in step c), the color constant composition so as to form the first color constant layer is applied on the structure obtained under step b) on the first optically variable layer and/or the second optically variable layer, in step d), the color constant composition so as to form the second color constant layer is applied on the structure obtained under step c) on the first optically variable layer and/or the second color optically variable layer, so that the first color constant layer is in direct contact with the first and/or the second optically variable layer, and/or the second constant layer is in direct contact with the first and/or the second optically variable layer.

Alternatively, other sequences of applying color constant compositions and optically variable compositions might be used provided that the first optically variable layer, the second optically variable layer, the first color constant layer, the second color constant layer and the one or more material-free regions are jointly visible from one side of the security thread or stripe as described hereinabove.

Alternatively, and when the security threads or stripes according to the present disclosure consist of structures wherein the first optically variable layer is disposed on top of the first color constant layer and/or the second color constant layer, and the second optically variable layer is disposed on top of the first color constant layer and/or the second color constant layer, those security threads or stripe may be prepared by a process wherein other sequences of applying color constant compositions and optically variable compositions might be used provided that i) the first optically variable layer, the second optically variable layer, the first color constant layer, the second color constant layer, and the one or more material-free regions are jointly visible from one side of the security thread or stripe as described hereinabove, ii) the first optically variable layer is disposed on top of the first color constant layer and/or the second color constant layer, and iii) the second optically variable layer is disposed on top of the first color constant layer and/or the second color constant layer.

When the security thread or stripe of the present disclosure is produced in such a way that two substrates are used to sandwich the first color constant layers, the second color constant layers, the first optically variable layers and the second optically variable layers, either one of the substrates can be used as the one that is closer to the security document than the other one. Preferably, the substrate that is adjacent to the first and/or second color constant layer will be used as the one that is closer to the security document than the other substrate.

When the expression "on top of" is used to describe the relationship of two layers of the security thread or stripe, as the security thread or stripe can be arranged upside down, it is possible that the layer on the top becomes the layer on the bottom. Both arrangements are with the scope of the present disclosure. In other words, when layer A is mentioned as on top of layer B, it is also within the scope of the present disclosure that the security thread or stripe is arranged up-side down so that layer B is on top of layer A. Preferably, "layer A is on top of layer B" indicates that layer B is closer to the substrate adjacent to the security document than layer A. In another aspect of the disclosure, in a preferred embodiment of the disclosure, the expression "on top of" also indicates that the two layers are in direct contact with each other.

As known by those skilled in the art, the term rotogravure refers to a printing process which is described for example in "Handbook of print media", Helmut Kipphan, Springer Edition, page 48. Rotogravure is a printing process wherein the image elements are engraved into the surface of a cylinder. The non-image areas are at a constant original level. Prior to printing, the entire printing plate (non-printing and printing elements) is inked and flooded with ink. Ink is removed from the non-image by a wiper or a blade before printing, so that ink remains only in the cells. The image is transferred from the cells to the substrate by a pressure typically in the range of 2 to 4 bars and by the adhesive forces between the substrate and the ink. The term rotogravure does not encompass intaglio printing processes (also referred in the art as engraved steel die or copper plate printing processes) which rely for example on a different type of ink.

Flexography preferably uses a unit with a doctor blade, preferably a chambered doctor blade, an anilox roller and plate cylinder. The anilox roller advantageously has small cells whose volume and/or density determines the ink application rate. The doctor blade lies against the anilox roller, and scraps off surplus ink at the same time. The anilox roller transfers the ink to the plate cylinder which finally transfers the ink to the substrate. Specific design might be achieved using a designed photopolymer plate. Plate cylinders can be made from polymeric or elastomeric materials. Polymers are mainly used as photopolymer in plates and sometimes as a seamless coating on a sleeve. Photopolymer plates are made from light-sensitive polymers that are hardened by ultraviolet (UV) light. Photopolymer plates are cut to the required size and placed in an UV light exposure unit. One side of the plate is completely exposed to UV light to harden or cure the base of the plate. The plate is then turned over, a negative of the job is mounted over the uncured side and the plate is further exposed to UV light. This hardens the plate in the image areas. The plate is then processed to remove the unhardened photopolymer from the nonimage areas, which lowers the plate surface in these nonimage areas. After processing, the plate is dried and given a post-exposure dose of UV light to cure the whole plate. Preparation of plate cylinders for flexography is described in *Printing Technology*, J. M. Adams and P. A. Dolin, Delmar Thomson Learning, 5$^{th}$ Edition, pages 359-360.

Screen printing (also referred in the art as silkscreen printing) is a stencil process whereby an ink is transferred to a surface through a stencil supported by a fine fabric mesh of silk, synthetic fibers or metal threads stretched tightly on a frame. The pores of the mesh are blocked-up in the non-image areas and left open in the image area, the image carrier being called the screen. Screen printing might be flat-bed or rotary. During printing, the frame is supplied with the ink, which is flooded over the screen and a squeegee is then drawn across it, thus forcing the ink through the open pores of the screen. At the same time, the surface to be printed is held in contact with the screen and the ink is transferred to it. Screen printing is further described for example in *The Printing ink manual*, R. H. Leach and R. J. Pierce, Springer Edition, 5$^{th}$ Edition, pages 58-62 and in *Printing Technology*, J. M. Adams and P. A. Dolin, Delmar Thomson Learning, 5$^{th}$ Edition, pages 293-328.

As known to those skilled in the art, after having applied the printing material on a surface (e.g., a substrate or an already hardened or cured material), said material is subjected to a hardening or curing step. During the hardening or curing step, the printing material is cured, dried, solidified, reacted or polymerized as described hereinabove, i.e. by radiation curing, by thermal drying or by a combination thereof.

A further step consisting of slicing the security threads or stripes according to aspects of the present disclosure may be achieved so as to provide security threads or stripes having preferably a width, i.e. dimension in the transverse direction, between about 0.5 mm and about 30 mm, more preferably between about 0.5 mm and about 5 mm.

The security threads or stripes according to the present disclosure are particularly suitable for the protection of a security document against counterfeiting or fraud. Therefore, the present disclosure provides the use of the security thread or stripe according to the present disclosure for the protection of a security document against counterfeiting or fraud. The present disclosure further provides security document comprising the security thread or stripe according to the present disclosure. The security document preferably comprises a substrate selected from the group consisting of papers, polymers and combinations thereof.

Security documents are usually protected by several security features which are chosen from different technology fields, manufactured by different suppliers, and embodied in different constituting parts of the security document. To break the protection of the security document, the counterfeiter would need to obtain all of the implied materials and to get access to all of the required processing technology, which is a hardly achievable task. Examples of security documents include without limitation value documents and value commercial goods. Typical example of value documents include without limitation banknotes, deeds, tickets, checks, vouchers, fiscal stamps and tax labels, agreements and the like, identity documents such as passports, identity cards, visas, bank cards, credit cards, transactions cards, access documents, entrance tickets and the like. The term "value commercial good" refers to packaging material, in particular for pharmaceutical, cosmetics, electronics or food industry that may comprise one or more security features in order to warrant the content of the packaging like for instance genuine drugs. Example of these packaging material include without limitation labels such as authentication brand labels, tamper evidence labels and seals. Preferably, the security document according to the present disclosure is selected from the group consisting of banknotes, identity documents such as passports, identity cards, driving licenses and the like, and more preferably banknotes.

The security thread or stripe according to the present disclosure can be incorporated into or onto any security document, in particular, papers and polymers used to make security documents so as to confer resistance against counterfeiting or illegal reproduction of the security thread or stripe.

Also described herein are processes for making security documents described herein and security documents obtained therefrom. The security documents according to the present disclosure may be prepared by a process comprising a step of at least partially or fully embedding therein the security thread or stripe described herein or a step of mounting the security thread or stripe described herein on the surface of the security document.

The security thread or stripe according to the present disclosure may be at least partially or fully embedded into the security document as a windowed security thread or stripe. When the security document comprises a substrate being a security paper, the security thread or stripe according to the present disclosure may be at least partially incorporated in the security paper during manufacture by techniques commonly employed in the paper-making industry. For example, the security thread or stripe according to the present disclosure may be pressed within wet paper fibers while the fibers are unconsolidated and pliable, thus resulting in the security thread or stripe being totally embedded in the resulting security paper. The security thread or stripe according to the present disclosure may also be fed into a cylinder mold papermaking machine, cylinder vat machine, or similar machine of known type, resulting in partial embedment of the security thread or stripe within the body of the finished paper (i.e., windowed paper).

Alternatively, the security thread or stripe according to the present disclosure may be disposed completely on the surface of the security document as a transfer element. In such as case, the security thread or stripe according to the present disclosure may be mounted on the surface of the security document by any known techniques including without limitation applying a pressure-sensitive adhesive to a surface of the security thread or stripe, applying a heat activated adhesive to a surface of the security thread or stripe or using thermal transfer techniques.

The invention claimed is:

1. A security thread or stripe comprising a substrate and:

i) a first optically variable layer imparting a first differing color impression at different viewing angles and being made of an optically variable composition comprising a plurality of optically variable pigments;

ii) a second optically variable layer imparting a second differing color impression at different viewing angles and being made of an optically variable composition comprising a plurality of optically variable pigments;

iii) a first color constant layer having a color matching the color impression of the first or second optically variable layer at a first viewing angle and being made of a color constant composition comprising a binder and a plurality of inorganic pigments, organic pigments or mixtures thereof;

iv) a second color constant layer having a color matching the color impression of the first or second optically variable layer at a second viewing angle and being made of a color constant composition comprising a binder and a plurality of inorganic pigments, organic pigments or mixtures thereof; and v) one or more material-free regions, wherein the first differing color impression is different from the second differing color impression, wherein the first optically variable layer and the second optically variable layer either comprise one or more gaps in the form of indicia or comprise indicia made of the optically variable compositions, wherein the substrate is a metalized material comprising a further indicia comprising clear text, wherein the further indicia is disposed in register with the one or more material-free regions, and wherein the first optically variable layer, the second optically variable layer, the first color constant layer, the second color constant layer, the one or more material-free regions, and the clear text are jointly visible from one side of the security thread or stripe.

2. The security thread or stripe according to claim 1, wherein the first optically variable layer is disposed on top of the first color constant layer and/or the second color constant layer, and the second optically variable layer is disposed on top of the first color constant layer and/or the second color constant layer.

3. The security thread or stripe according to claim 1, wherein the first optically variable layer is in direct contact with the first color constant layer and/or the second color constant layer, and the second optically variable layer is in direct contact with the first color constant layer and/or the second color constant layer.

4. The security thread or stripe according to claim 1, wherein the first viewing angle under which the first color constant layer has a color matching the color impression of the first or second optically variable layer is the same as the second viewing angle under which the second color constant layer has a color matching the color impression of the first or second optically variable layer.

5. The security thread or stripe according to claim 1, wherein the first viewing angle under which the first color constant layer has a color matching the color impression of the first or second optically variable layer is different from the second viewing angle under which the second color constant layer has a color matching the color impression of the first or second optically variable layer.

6. The security thread or stripe according to claim 1, wherein at least a part of the plurality of optically variable pigments consists of thin film interference pigments, magnetic thin film interference pigments, interference coated pigments, cholesteric liquid crystal pigments and mixtures thereof.

7. The security thread or stripe according to claim 6, wherein the thin film interference pigments comprise a Fabry-Perot absorber/dielectric/reflector/dielectric/absorber multilayer structure.

8. The security thread or stripe according to claim 7, wherein the reflector layer of the multilayer structure is selected from the group consisting of metals, metal alloys, and combinations thereof; and/or the dielectric layers of the multilayer structure are independently selected from the group consisting of magnesium fluoride ($MgF_2$), silicium dioxide ($SiO_2$), and mixtures thereof; and/or the absorber layers of the multilayer structure are independently selected from the group consisting of chromium, nickel, metal alloys, and mixtures thereof.

9. The security thread or stripe according to claim 7, wherein the Fabry-Perot absorber/dielectric/reflector/dielectric/absorber multilayer structure is a multilayer structure of $Cr/MgF_2/Al/MgF_2/Cr$.

10. The security thread or stripe according to claim 7, wherein the magnetic thin film magnetic interference pigments comprise a 5-layer Fabry-Perot absorber/dielectric/reflector/dielectric/absorber multilayer structure wherein the reflector and/or the absorber is a magnetic layer.

11. The security thread or stripe according to claim 10, wherein the magnetic thin film magnetic interference pigments comprise a 7-layer Fabry-Perot absorber/dielectric/reflector/magnetic/reflector/dielectric/absorber multilayer structure.

12. The security thread or stripe according to claim 11, wherein the 7-layer Fabry-Perot absorber/dielectric/reflector/magnetic/reflector/dielectric/absorber layer is a multilayer structure of $Cr/MgF_2/Al/Ni/Al/MgF_2/Cr$.

13. The security thread or stripe according to claim 10, wherein the reflector layers of the multilayer structure are independently selected from the group consisting of metals, metal alloys, and combinations thereof; and/or the dielectric layers of the multilayer structure are independently selected from the group consisting of magnesium fluoride ($MgF_2$), silicium dioxide ($SiO_2$), and mixtures thereof; and/or the absorber layers of the multilayer structure are selected from the group consisting of chromium, nickel, metal alloys, and mixtures thereof, and/or the magnetic layer of the multilayer structure is selected from the group consisting of nickel (Ni), iron (Fe) and cobalt (Co), and mixtures thereof.

14. The security thread or stripe according to claim 1, wherein the substrate is selected from the group consisting of plastics, polymers, composite materials, metals, and mixtures thereof.

15. The security thread or stripe according to claim 1, further comprising one or more protective layers.

16. The security thread or stripe according to claim 1, further comprising one or more additional layers selected from the group consisting of adhesive layers, lacquers, machine readable layers, hiding layers, and combinations thereof.

17. The security thread or stripe according to claim 16, wherein the machine readable layer comprises a machine readable material selected from the group consisting of magnetic materials, luminescent materials, electrically conductive materials, infrared-absorbing materials, and mixtures thereof.

18. The security thread or stripe according to claim 1, wherein the first optically variable layer and the second optically variable layer consist of radiation curable compositions, thermal drying compositions, or any combination thereof.

19. The security thread or stripe according to claim 1, wherein the indicia are selected from the group consisting of symbols, alphanumeric symbols, motifs, geometric patterns, letters, words, numbers, logos, drawings, and combinations thereof.

20. The security thread or stripe according to claim 1, having a width between about 0.5 mm and about 30 mm.

21. A process for making the security thread or stripe recited in claim 1 comprising:

a) applying the color constant composition so as to form the first color constant layer onto the substrate, b) applying the color constant composition so as to form the second color constant layer on the structure obtained under a), wherein the color constant composition of b) is different from the color constant composition of a)

c) applying the optically variable composition so as to form a first optically variable layer on the structure obtained under b) by a process selected from the group consisting of rotogravure, screen printing, and flexography either while keeping one or more gaps in the form of indicia, or by applying the optically variable composition in the form of indicia, d) applying the optically variable composition so as to form a second optically variable layer on the structure obtained under c) by a process selected from the group consisting of rotogravure, screen printing, and flexography either while keeping one or more gaps in the form of indicia, or by applying the optically variable composition in the form of indicia, wherein the optically variable composition of d) is different from the optically variable composition of c), wherein the compositions of a) to d) are applied while keeping one or more material-free regions on the substrate.

22. The process of claim 21, further comprising applying a second substrate on the structure obtained under d).

23. The process of claim 22, further comprising applying a thermoadhesive layer on one or both sides of a structure comprising the second substrate on the structure obtained under d).

24. The process of claim 21, further comprising applying a thermoadhesive layer on one or both sides of the structure obtained under d).

25. A process for making the security thread or stripe recited in claim 1 comprising:

a) applying the optically variable composition so as to form a first optically variable layer on the substrate by a process selected from the group consisting of rotogravure, screen printing, and flexography either while keeping one or more gaps in the form of indicia, or by applying the optically variable composition in the form of indicia, b) applying the optically variable composition so as to form a second optically variable layer on the structure obtained under a) by a process selected from the group consisting of rotogravure, screen printing, and flexography either while keeping one or more gaps in the form of indicia, or by applying the optically variable composition in the form of indicia, wherein the optically variable composition of b) is different from the optically variable composition of a), c) applying the color constant composition so as to form the first color constant layer on the structure obtained under b), d) applying the color constant composition so as to form the second color constant layer on the structure obtained under c), wherein the color constant composition of d) is different from the composition of c), wherein the compositions of a) to d) are applied while keeping one or more material-free regions on the substrate.

26. The process of claim 25, further comprising applying a second substrate on the structure obtained under d).

27. The process of claim 26, further comprising applying a thermoadhesive layer on one or both sides of a structure comprising the second substrate on the structure obtained under d).

28. The process of claim 25, further comprising applying a thermoadhesive layer on one or both sides of the structure obtained under d).

29. A process for making the security thread or stripe recited in claim 1 comprising:

a) applying the optically variable composition so as to form a first optically variable layer on the substrate by a process selected from the group consisting of rotogravure, screen printing, and flexography either while keeping one or more gaps in the form of indicia, or by applying the optically variable composition in the form of indicia, b) applying the optically variable composition so as to form a second optically variable layer on the structure obtained under a) on the substrate by a process selected from the group consisting of rotogravure, screen printing, and flexography either while keeping one or more gaps in the form of indicia, or by applying the optically variable composition in the form of indicia, wherein the optically variable composition of b) is different from the optically variable composition of a), c) applying the color constant composition so as to form the first color constant layer on the structure obtained under b) on the first optically variable layer and/or the second optically variable layer, d) applying the color constant composition so as to form the second color constant layer on the structure obtained under c) on the first optically variable layer and/or the second optically variable layer, wherein the color constant composition of d) is different from the composition of c), wherein the compositions of a) to d) are applied while keeping one or more material-free regions on the substrate.

30. The process of claim 29, further comprising applying a second substrate on the structure obtained under d).

31. The process of claim 29, further comprising applying a second substrate on the structure obtained under d).

32. The process of claim 31, further comprising applying a thermoadhesive layer on one or both sides of a structure comprising the second substrate on the structure obtained under d).

33. The process of claim 29, further comprising applying a thermoadhesive layer on one or both sides of the structure obtained under d).

34. A use of the security thread or stripe recited in claim 1 for the protection of a security document against counterfeiting or fraud, comprising mounting the security thread or stripe on the security document or embedding the security thread or stripe in the security document.

35. A security document comprising a security thread or stripe recited in claim 1.

36. A process for making the security document recited in claim 35, comprising at least partially or fully embedding in the security document the security thread or stripe or mounting the security thread or stripe on the surface of the security document.

* * * * *